US008459411B2

(12) United States Patent
Maurice et al.

(10) Patent No.: US 8,459,411 B2
(45) Date of Patent: Jun. 11, 2013

(54) FOOT LOCK ASCENDER FOR ASCENDING ALONG A ROPE

(75) Inventors: Alain Maurice, Saint Hilaire du Touvet (FR); Paul Petzl, Barraux (FR)

(73) Assignee: Zedel, Crolles (FR)

( * ) Notice: Subject to any disclaimer, the term of this patent is extended or adjusted under 35 U.S.C. 154(b) by 510 days.

(21) Appl. No.: 12/379,162

(22) Filed: Feb. 13, 2009

(65) Prior Publication Data

US 2009/0236177 A1 Sep. 24, 2009

(30) Foreign Application Priority Data

Mar. 21, 2008 (FR) ..... 08 01567

(51) Int. Cl.
*A63B 29/00* (2006.01)

(52) U.S. Cl.
USPC ..... 182/134; 182/221

(58) Field of Classification Search
USPC ..... 182/134, 221
See application file for complete search history.

(56) References Cited

U.S. PATENT DOCUMENTS

| | | | | | |
|---|---|---|---|---|---|
| 938,905 | A | * | 11/1909 | Speerstra | 182/221 |
| 1,505,360 | A | * | 8/1924 | Lowery | 182/134 |
| 5,794,272 | A | * | 8/1998 | Workman et al. | 2/421 |
| 6,081,932 | A | * | 7/2000 | Kraemer | 2/421 |

FOREIGN PATENT DOCUMENTS

| | | | |
|---|---|---|---|
| FR | 2 597 760 | A1 | 10/1987 |
| FR | 2 790 968 | A1 | 9/2000 |
| FR | 2790968 | A1 * | 9/2000 |
| WO | WO 90/05001 | A1 | 5/1990 |

* cited by examiner

*Primary Examiner* — Alvin Chin Shue
(74) *Attorney, Agent, or Firm* — Oliff & Berridge, PLC

(57) ABSTRACT

A foot lock ascender for ascending along a rope including a swivelling gate and attachment portion including at least a first passage for a first strap to pass through and to be adjusted, and at least a second passage for a second strap to pass through. The first strap is inclined by a predefined angle with respect to the throat, the angle is between 40° and 75° so as to keep the bottom of the throat parallel to the path of the rope when ascending.

2 Claims, 6 Drawing Sheets

FOOT LOCK ASCENDER FOR ASCENDING ALONG A ROPE

BACKGROUND OF THE INVENTION

The invention relates to a foot lock ascender for ascending along a rope, comprising:

- an ascender element having a metal body equipped with a throat for guiding the rope, and a movable gate mounted pivoting on the body around a swivel-pin between a closed position and an open position to respectively press the rope against the bottom of the throat when the body is solicited in the descending direction and to release the rope in the opposite ascending direction,
- a first attachment device comprising at least one passage for a first strap designed to wrap round the user's ankle to pass through, and a second attachment device of a second strap designed to pass under the sole of the user's shoe.

Such an ascender can be fixed to the shoe of the right or left foot and makes for easier ascending along a rope in the field of mountaineering, rock-climbing, caving, or working at heights.

The first strap surrounds the instep and is associated with a securing loop, whereas the second strap passes under the shoe and is secured to the first strap opposite the second strap passage.

STATE OF THE ART

A foot lock ascender of the kind referred to is represented in FIGS. 1 to 3 and is described in detail in the document FR 2790968.

With reference to FIGS. 1 to 3, a foot lock ascender, designated by the general reference number 10, comprises a locking element 12 associated with a pair of straps 14, 16 for fixing to a shoe. Locking element 12 is provided with a metal body 18 folded into a C shape inside which a pivoting gate 20 is articulated enabling the user to ascend along a rope 11. Gate 20 comprises a jamming surface 22 with spikes designed to press the rope against a throat 24 when body 18 of locking element 12 is urged downwards by the weight of the user. When ascending along the rope, gate 20 pivots clockwise around swivel-pin 26 to an open position to release the rope. A securing loop 28 is associated with the horizontal first strap 14 for fixing the assembly to the user's foot.

Body 18 of locking element 12 is made from cut, stamped and folded metal plate and comprises two attachment devices 30, 32 arranged in the flat part for passage and adjustment of straps 14, 16. The top first attachment device 30 is provided with four substantially parallel horizontally-aligned vertical slots 34 defining two passages 36, 38 for strap 14 to pass through. Bottom second attachment device 32 comprises two parallel horizontal slots 40 forming a passage 42 for vertical second strap 16 to pass through. A hole 44 is arranged in body 18 for hooking a carabiner onto. A return spring 46 is fitted on swivel-pin 26 to bias gate 20 to the closed position.

First strap passages 36, 38 extend orthogonally with respect to second strap passage 42 being integrated in the flat part of the body between throat 24 and swivel-pin 26 of gate 20. After first strap 14 has been fitted, the latter extends perpendicularly with respect to throat 24.

When the user ascends (FIG. 3), foot lock 10 rubs against the top edge of throat 24, hampering sliding of the ascender along rope 11.

This difficulty in sliding has the consequence of reducing the speed of progression and requires a greater effort from the user.

OBJECT OF THE INVENTION

The object of the invention consists in providing a perfected foot lock ascender enabling friction to be limited and improving sliding of the rope when ascending.

The foot lock ascender according to the invention is characterized in that the first attachment device of the first strap is inclined by a predefined angle with respect to the guide throat of the rope, said angle being comprised between 40° and 75° so as to keep the bottom of the throat parallel to the path of the rope when ascending.

According to a preferred embodiment, the angle of incline of the first strap passage is close to 60°. The first strap passage is formed by four parallel slots offset two by two in the heightwise direction to define said angle of incline.

Such an arrangement of the first passage places the first strap in a position preventing any friction of the rope against the top edge of the throat. The rope remains parallel to the bottom of the throat and the ascender slides freely when the user raises his legs for ascending.

BRIEF DESCRIPTION OF THE DRAWINGS

Other advantages and features will become more clearly apparent from the following description of an embodiment of the invention given for non-restrictive example purposes only and represented in the accompanying drawings, in which.

DESCRIPTION OF A PREFERRED EMBODIMENT

Figure 1:
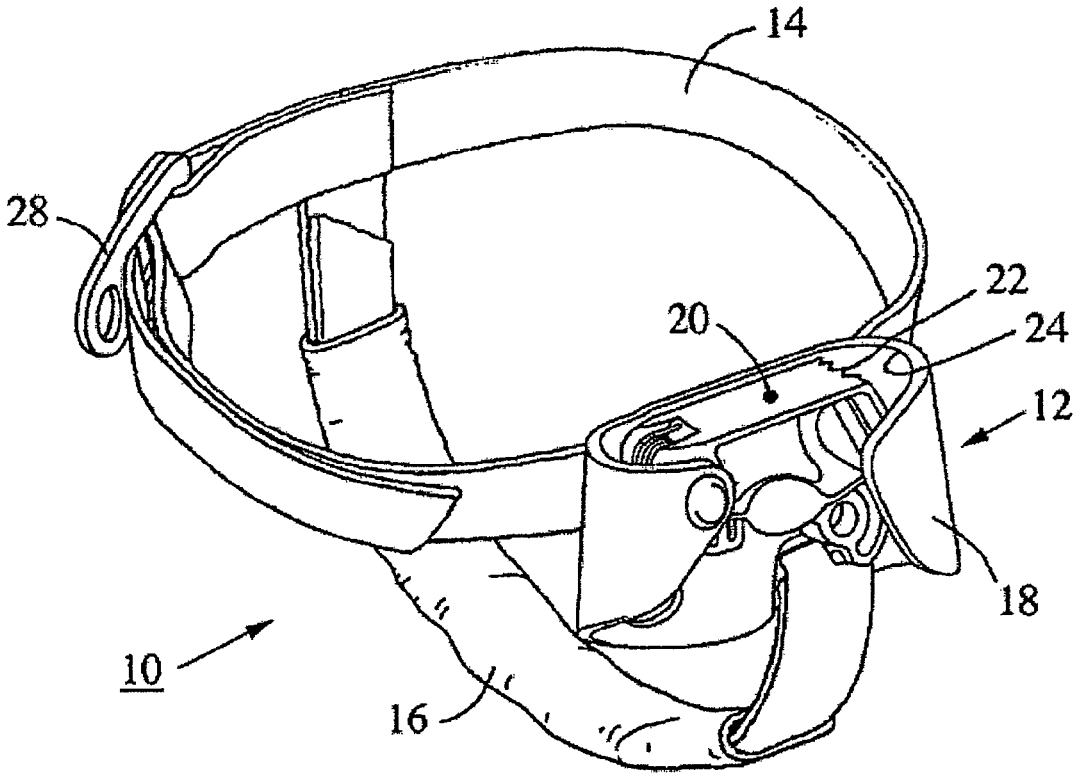
FIG : 1 Prior art
FIG. 1 is a perspective view of a known foot lock ascender according to the prior art.
Figure 2:
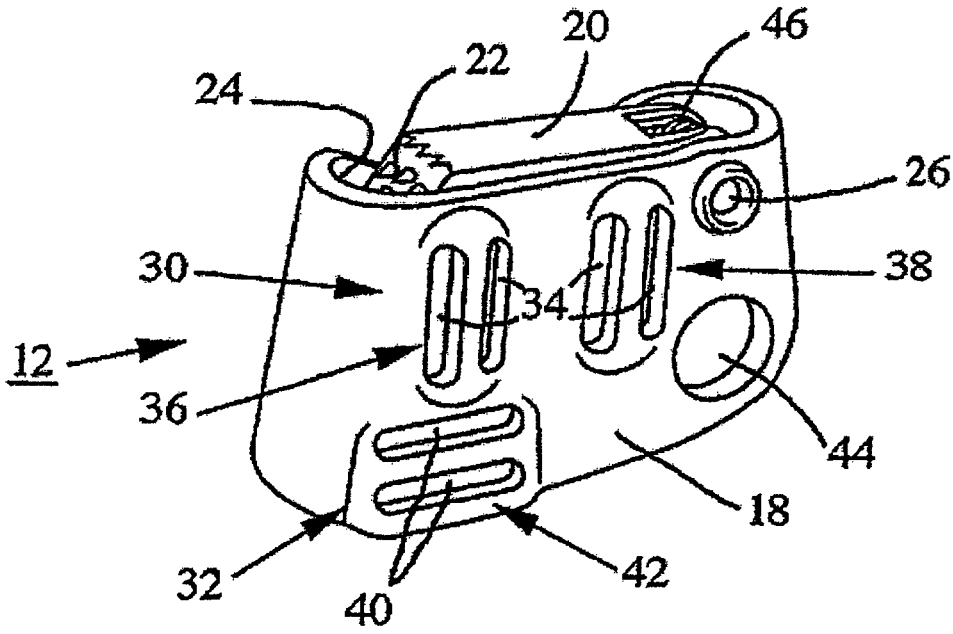
fig: 2 Prior art
FIG. 2 is a rear view of the ascender device of FIG. 1 without the straps.
Figure 3:
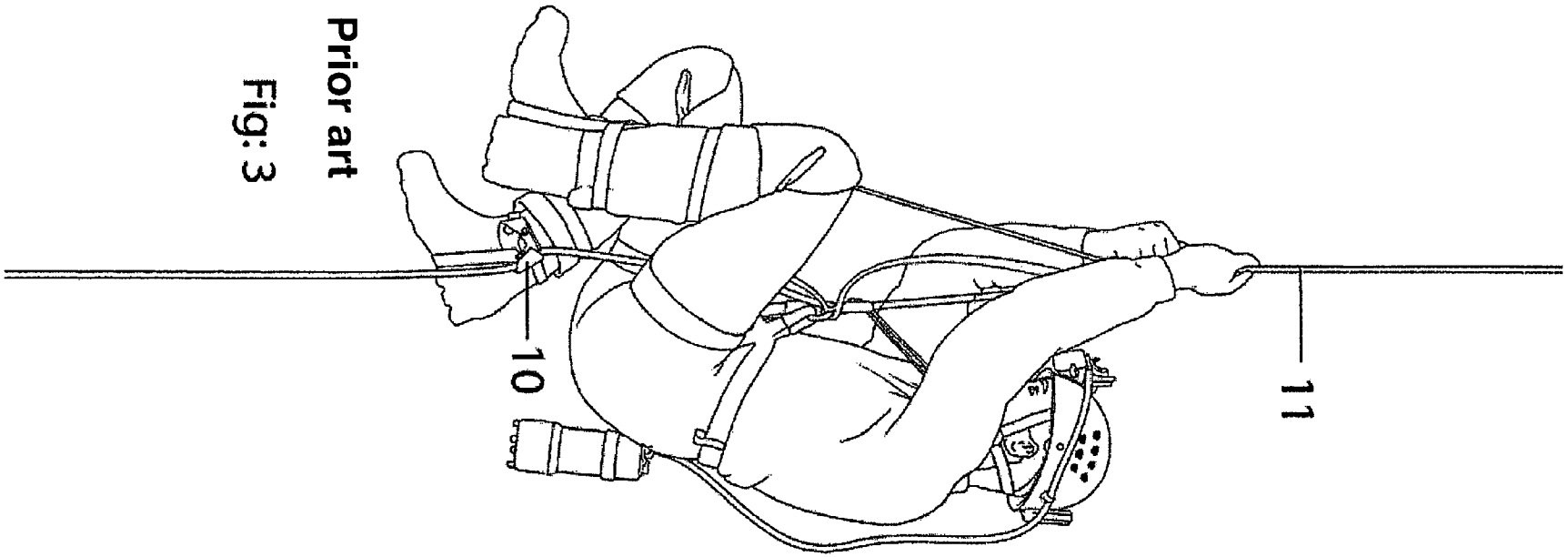
Prior art Fig: 3
FIG. 3 illustrates a perspective view of a user ascending with the foot lock ascender of FIG. 1.
Figure 4:
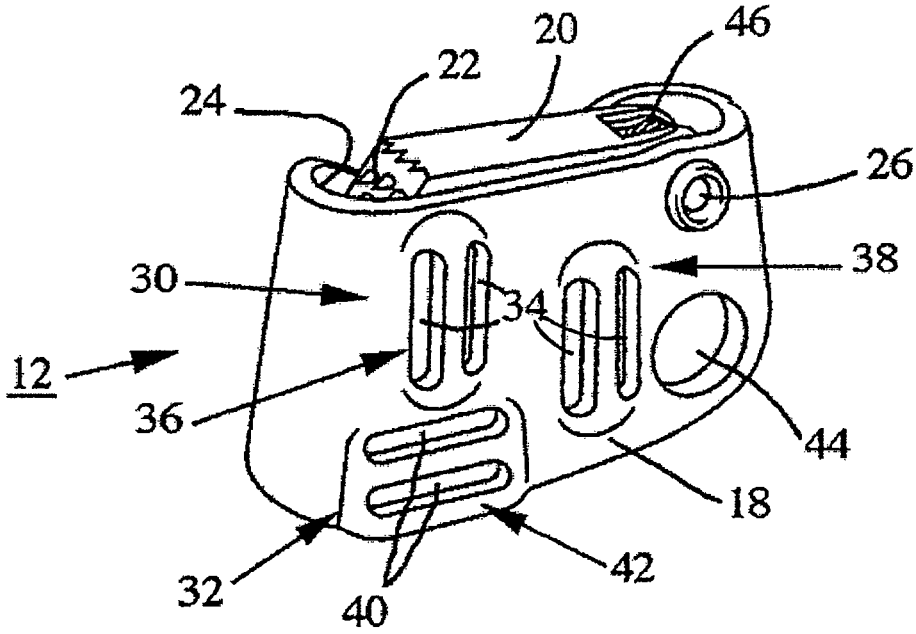
FIG. 4 is an identical view to FIG. 2 of a foot lock ascender according to an embodiment of the invention.
Figure 5:
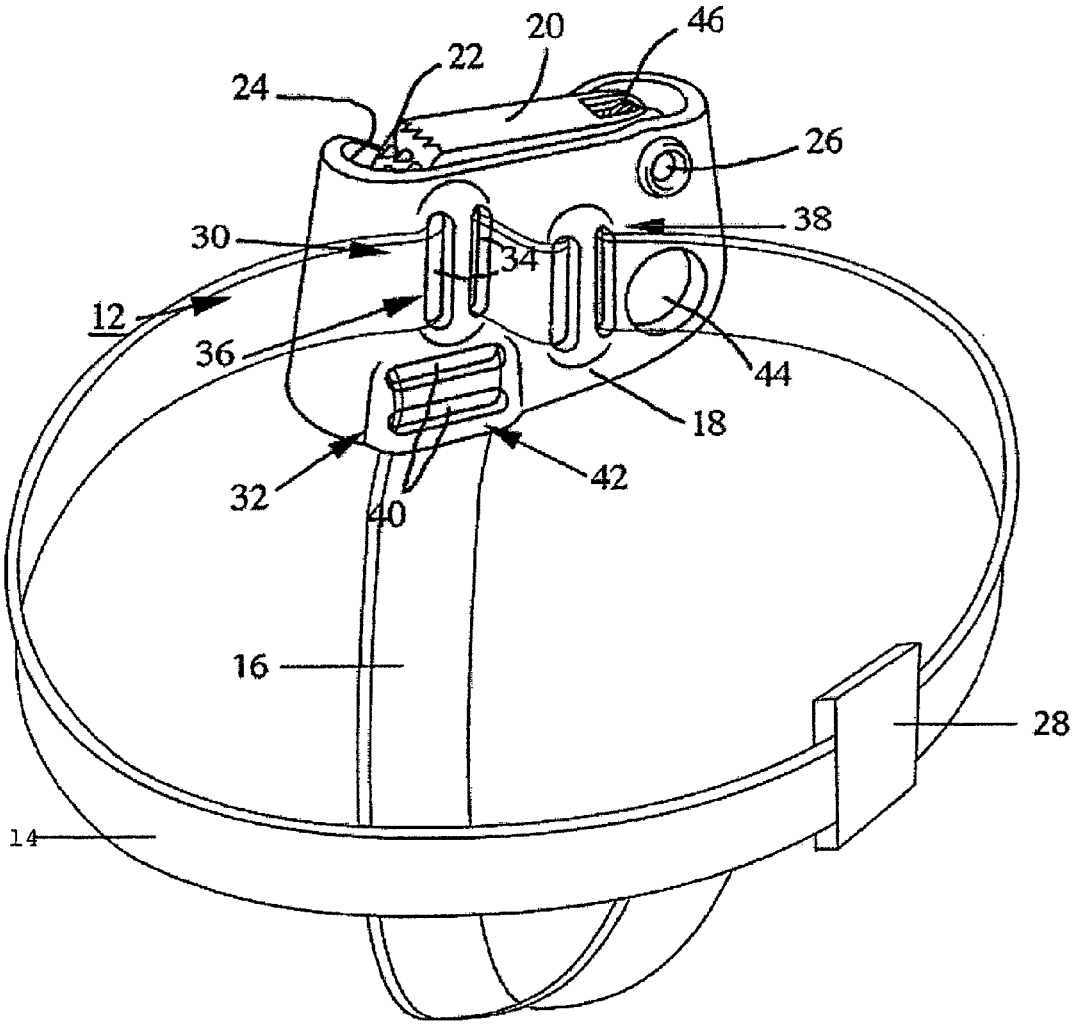
FIG. 5 is a rear view of the foot lock ascender of FIG. 4 with the strap system.
Figure 6:
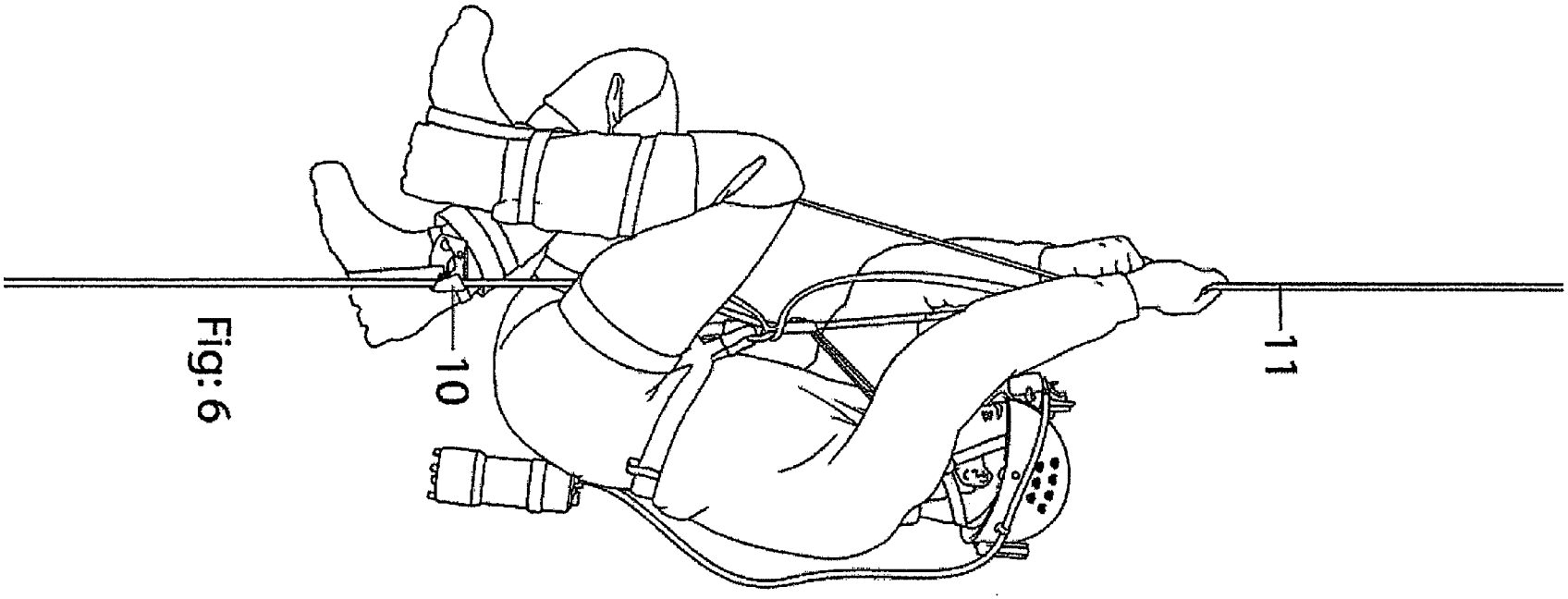
FIG. 6 is an identical view to FIG. 3 with the foot lock ascender according to an embodiment of the invention.

In FIGS. 4 to 6, the same reference numbers will be used to designate identical or similar parts to those of FIGS. 1 to 3.

The structure of the ascender device 12 is identical to that of FIG. 2 with the exception of the positioning of the first attachment device 30 which is inclined downwards by a predefined angle with respect to the throat 24.

When the first strap 14 is fitted, the angle of the latter is advantageously comprised between 40° and 75° with respect to throat 24.

The bottom of throat 24 remains parallel to the path of the rope 11 when ascending (FIG. 6). Ascending device 12 can thus slide freely without any friction of the rope on the top of throat 24.

The first attachment device 30 is formed by four parallel slots 34 forming two strap passages 36, 38 offset two by two in the heightwise direction to define said angle of incline. The first strap 14 thus passes through the two passages 36, 38 in an inclined direction with respect to the horizontal.

The second attachment device 32 is identical to that of FIG. 2 and is formed by two superposed parallel slots 40.

The invention claimed is:

1. A foot lock ascender for ascending along a rope, the foot lock ascender comprising:

an ascender element having a metal body equipped with a throat for guiding the rope and extending along a vertical axis of the ascender element, and a movable gate fitted pivoting on the body around a swivel-pin between a closed position and an open position to respectively press the rope against a bottom portion of the throat when the body is acted upon in a descending direction and to release the rope in an opposite ascending direction, the bottom portion of the throat being parallel to a path of the rope such that the ascender slides freely by avoiding friction between the rope and a top portion of the throat;

a first attachment device including a first strap passage and a second strap passage, the first strap passage having two parallel slots and the second strap passage having two parallel slots, the strap passages of the first attachment device forming passages for a first strap to pass through and allowing the first strap to wrap around a user's ankle; and a second attachment device including a third strap passage, the third strap passage forming a passage for a second strap to pass through and allowing the second strap to extend under a sole of a user's shoe, wherein the first strap is inclined by a predefined angle, between the first strap passage and the second strap passage on the ascender element, with respect to a horizontal axis of the throat, the angle of incline is between 40° and 75° so as to keep the bottom of the throat parallel to the path of the rope when ascending;

the slots of the first strap passage are offset in a heightwise direction from the slots of the second strap passage, the offset of the passages defines the angle of incline; the first strap passage being adjacent to the throat and the second strap passage being distal from the throat, the first strap passage is at a greater height in the heightwise direction that the second strap passage, the first strap being inclined upwardly towards the throat;

the inclination of the first strap due to the offset of the slots limits friction and improves sliding of the rope when ascending;

the first strap passes through the first and second strap passages in an inclined direction with respect to a horizontal axis of the ascender element the slots of the first attachment device are vertical slots and arranged perpendicularly with respect to two horizontal slots of the third strap passage of the Second attachment device; and the two parallel slots of the first strap passage and the two parallel slots of the second strap passage are all parallel.

2. The foot lock ascender according to claim 1, wherein the angle of incline of the strap passages of the first attachment device is close to 60°.

* * * * *